United States Patent [19]

Baranow

[11] 4,010,024

[45] Mar. 1, 1977

[54] PROCESS FOR PREPARING METAL HAVING A SUBSTANTIALLY UNIFORM DISPERSION OF HARD FILLER PARTICLES

[75] Inventor: Sanford Baranow, Souquoit, N.Y.

[73] Assignee: Special Metals Corporation, New Hartford, N.Y.

[22] Filed: June 16, 1975

[21] Appl. No.: 587,026

[52] U.S. Cl. ..... 75/.5 BC; 241/22

[51] Int. Cl.[2] ..... B22F 9/00

[58] Field of Search ..... 75/.5 R, .5 B, .5 BA, 75/.5 BB, .5 BC; 241/22

[56] References Cited

UNITED STATES PATENTS

| | | | |
|---|---|---|---|
| 3,723,092 | 3/1973 | Benjamin | 75/.5 R |
| 3,743,548 | 7/1973 | Baranow | 75/.5 AC |
| 3,778,249 | 12/1973 | Benjamin | 75/.5 R |
| 3,809,545 | 5/1974 | Benjamin | 75/.5 R |
| 3,865,572 | 2/1975 | Fisher et al. | 75/.5 R |
| 3,877,930 | 4/1975 | Volin | 75/.5 R |

*Primary Examiner*—W. Stallard

*Attorney, Agent, or Firm*—Vincent G. Gioia; Robert F. Dropkin

[57] ABSTRACT

A process for preparing metal having a substantially uniform dispersion of hard filler particles. The process includes the steps of: admixing metal powder and oxide particles having a negative free energy of formation at 1000° C of at least as great as that of aluminum oxide; and of milling the mixture for a period of time sufficient to effect a substantially uniform dispersion of said oxide particles in said metallic powder. Milling is performed in an atmosphere containing sufficient oxygen to substantially preclude welding of particles of said metallic powder to other such particles. After milling, the dispersion strengthened powder is heat treated to remove excess oxygen therefrom.

4 Claims, No Drawings

PROCESS FOR PREPARING METAL HAVING A SUBSTANTIALLY UNIFORM DISPERSION OF HARD FILLER PARTICLES

The present invention relates to a process for preparing metal having a substantially uniform dispersion of hard filler particles.

Today there are a number of processes for preparing oxide-strengthened metallic powder. Some of these processes are chemical in nature as evidenced by U.S. Pat. Nos. 3,458,306 and 3,525,498. Still others are mechanical in nature as evidenced by U.S. Pat. No. 3,591,362.

The mechanical process described in U.S. Pat. No. 3,591,362 calls for the admixing of metal powder and oxide particles and the subsequent milling thereof; and, moreover, discloses a process capable of preparing metal having a substantially uniform dispersion of oxide particles. Said patent does not, however, disclose an efficient process for attaining the end result. As particle sizes increase during milling, milling for a prolonged period of time is required.

The present invention provides a mechanical process for preparing oxide-strengthened metallic powder, in which the milling operation is made more efficient. More specifically, it calls for milling in an atmosphere containing sufficient oxygen to prevent welding of the individual particles of metallic powder. As a result the time required for adequate milling is considerably shortened. Powder milled in accordance with the present invention has a Fisher No. no greater than 15. On the other hand, powder milled in accordance with U.S. Pat. No. 3,591,362 is considerably larger in size.

It is accordingly an object of the present invention to provide a more efficient process for preparing oxide strengthened metallic powder.

In accordance with the present invention: metal powder is admixed with oxide particles having a negative free energy of formation at 1000° C of at least as great as that of aluminum oxide; and subsequently milled for a period of time sufficient to effect a substantially uniform dispersion of the oxide particles in the metallic powder. Milling is performed in an atmosphere containing sufficient oxygen to substantially preclude welding of particles of metallic powder to other such particles. After milling the dispersion strengthened metallic powder has a Fisher No. of less than 15. In general the Fisher No. is less than 10, and in most instances it is less than 8. Subsequent to milling, the powder is heat treated to remove excess oxygen. The heat treatment is generally performed in a reducing atmosphere, such as hydrogen.

In order to preclude welding during milling, oxygen must be present in an amount greater than that encountered when powders are milled in the air often present in a mill. More specifically, oxygen must be present in an amount sufficient to oxidize individual particles of powder, and thereby prevent agglomeration. To attain such an oxygen level, oxygen is supplied through a gaseous source such as air or water vapor or through an oxygen-bearing compound such as ammonium carbonate or ammonium bicarbonate. Heat created in the mill causes the oxygen-bearing compound to decompose, and release oxygen.

By precluding welding of the individual powder particles, the present invention improves upon the efficiency of the mechanical process disclosed in heretofore referred to U.S. Pat. No. 3,591,362. It takes less time to obtain a uniform dispersion of oxide particles in metallic powder of a small size, than in particles of metallic powder which are growing through a process of agglomeration and disintegration. By maintaining a small particle size, the present invention is characterized by metallic powder having a higher surface to volume ratio than that of the powder of U.S. Pat. No. 3,591,362.

There is reason to believe that any number of metal powders can be treated in accordance with the teachings of the present invention. Powders of nickel and cobalt, and alloys thereof, appear to be particularly adaptable thereto. Copper and copper alloy powders are also of considerable interest. Alloy additions which are not readily reducible by hydrogen, such as chromium, aluminum, titanium and zirconium, are, however, preferably added subsequent to milling.

The oxide particles must have a negative free energy of formation at 1000° C of at least as great as that of aluminum oxide. Oxides of yttrium and thorium are particularly suitable for use with nickel, cobalt, and alloys thereof. Aluminum oxide is compatible for use with copper and copper alloys.

The dispersion strengthened metal powder produced in accordance with the subject invention is suitable for consolidaton by any number of methods. Exemplary methods include extrusion, rolling, swaging and forging.

The following examples are illustrative of several aspects of the invention.

EXAMPLE I.

A charge of 30 pounds of carbonyl nickel, 0.48 pounds of yttrium oxide and 1.5 pounds of ammonium bicarbonate were placed in an attritor and milled for eight hours under a blanket of argon. During milling, the bicarbonate was continuously decomposed as evidenced by the smell of ammonia emanating from the attritor. The powder was discharged from the attritor, a fresh charge was added, and the entire process was repeated. Both lots of powder had a Fisher No. of approximately 5.5 The two lots of powder were subsequently combined and passed through a hydrogen pushpull furnace at the rate of 30 pounds of powder per hour. The peak furnace temperature was 1750° F.

A small portion of this powder was packed into a mild steel container of 2⅝ inches O.D., evacuated, sealed, and extruded at 2050° F, at an extrusion rate of 12/1. The extruded material was cold swaged 70%. After 25% working, the 2000° F ultimate tensile strength was 8.0 ksi whereas after 70% working, the ultimate tensile strength was 13.1 ksi. Specimens were tested after a one hour anneal at 2000° F. Those skilled in the art will recognize these properties as typical for material of this class, and that pure nickel similarly worked has a tensile strength of about 3 ksi at 2000° F.

EXAMPLE II.

About 20 pounds of a 150 mesh master alloy powder consisting of 76% chromium and 24% aluminum was milled for two hours under argon in an attritor, and discharged subsequent to cooling for about one-half hour. Most of the powder product of Example I was combined with this master alloy powder and thumbled in a twin shell blender for about an hour. The blended powder was milled in two batches for one-half hour each, and combined. The composition of the combined powder was 16% chromium, 5% aluminum, 1.2% yttrium oxide, balance nickel. About 70 pounds of the powder was pressed to 50% of its theoretical density in a mild steel can of 7¾ inches O.D. The can was evacuated, sealed, and extruded at 2050° F at a reduction in area of 15/1. Subsequent to recrystallizaton at 2450° F, it was found that a medium grain size structure had been developed with a desirable cube-on-edge texture. Those skilled in the art will recognize that such a texture is necessary for high thermal fatique resistance. Transverse mechanical properties at 2000° F showed a stress rupture life in excess of 20 hours at 5.5 ksi and an ultimate tensile strength of 10.3 ksi.

EXAMPLE III.

Two batches of powder each containing 19.7 pounds of nickel and 0.3 pounds of yttrium oxide were milled for four hours in an attritor, in an atmosphere of flowing air. The milled powder had a Fisher No. of 4.0. After milling, the batches of powder were combined and hydrogen reduced in a push-pull furnace operating at a temperature of 1700° F. The reduced powder was then pulverized and blended with 21% of a master alloy consisting of 76% chromium and 24% aluminum. The new blend was then milled for one hour in two batches under a blanket of argon. The milled powder was subsequently pressed in a mild steel can to a density of 65% of theoretical density. The canned billet was then evacuated, sealed, and extruded at 1950° F, at an extrusion ratio of 13/1 through a rectangular die. After subjecting the extruding slab to a 5% reduction by rolling at 1850° F and heat treating at 2450° F to effect recrystallization, tests were performed at 2000° F. Transverse mechanical properties exhibited a stress rupture life in excess of 20 hours at 6 ksi. Longitudinal mechanical properties exhibited a stress rupture life in excess of 20 hours at 8 ksi.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. A process for preparing metal having a substantially uniform dispersion of hard filler particles, which comprises the steps of: admixing metal powder from the group consisting of nickel, cobalt and alloys thereof and oxide particles having a negative free energy of formation at 1000° C of at least as great as that of aluminum oxide; milling the mixture for a period of time sufficient to effect a substantially uniform dispersion of said oxide particles in said metallic powder, said milling being in an oxygen containing atmosphere, said atmosphere containing sufficient oxygen to substantially preclude welding of particles of said metallic powder to other particles of said metallic powder, said oxygen being present in an amount greater than that encountered when powders are milled in the air often present in a mill, said oxygen being supplied from an external gaseous source or from an oxygen-bearing compound which is admixed with said metal powder and oxide particles; said dispersion strengthened powder having a Fisher No. of less than 15; heat treating said dispersion strengthened powder to remove excess oxygen therefrom; and subsequently blending said dispersion strengthened powder with powder which is not readily reduceable by hydrogen.

2. A process according to claim 1, wherein said dispersion strengthened powder has a Fisher No. of less than 10.

3. A process according to claim 1, wherein oxygen is supplied by a gaseous source.

4. A process according to claim 1, wherein oxygen is supplied by an oxygen-bearing compound which is admixed with said metal powder and oxide particles.

* * * * *